US006319155B1

(12) United States Patent
Moriyama et al.

(10) Patent No.: US 6,319,155 B1
(45) Date of Patent: Nov. 20, 2001

(54) MULTI-PIECE SOLID GOLF BALL

(75) Inventors: Keiji Moriyama, Akashi; Kazunari Yoshida, Kasai; Takeshi Asakura, Akashi; Takahiro Sajima, Izumi; Keiji Ohama, Akashi, all of (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/635,851

(22) Filed: Aug. 11, 2000

(30) Foreign Application Priority Data

Aug. 11, 1999 (JP) ..... 11-227442

(51) Int. Cl.[7] ..... A63B 37/12; A63B 37/14; A63B 37/04; A63B 37/06

(52) U.S. Cl. ..... 473/378; 473/371; 473/374; 473/375; 473/376

(58) Field of Search ..... 473/351, 361, 473/362, 364, 365, 367, 368, 370, 371, 373, 374, 376, 377, 378, 379, 380, 381, 382, 383, 384

(56) References Cited

U.S. PATENT DOCUMENTS 5,024,444 * 6/1991 Yamagishi et al. ..... 473/384
5,184,828 * 2/1993 Kim et al. ..... 473/373
5,800,287 * 9/1998 Yokota et al. ..... 473/372

* cited by examiner

*Primary Examiner*—Mark S. Graham
*Assistant Examiner*—Alvin A. Hunter, Jr.
(74) *Attorney, Agent, or Firm*—Birch, Stewart, Kolasch & Birch, LLP

(57) ABSTRACT

The present invention is directed to a multi-piece solid golf ball exhibiting excellent flight performance by optimizing the trajectory of the golf ball during flight. The golf ball of the present invention satisfies the formula $1020 \leqq (NY+266H) \leqq 1085$ with total number of dimples being N, the quotient Y being determined by dividing A by B in which A is the total area of a plane defined by a dimple edge and B is a surface area of a sphere when the sphere is formed assuming that there is no dimple on the cover, and a deformation amount H when applying from an initial load of 10 kgf to a final load of 130 kgf on the golf ball.

5 Claims, 5 Drawing Sheets

MULTI-PIECE SOLID GOLF BALL

FIELD OF THE INVENTION

The present invention relates to a multi-piece solid golf ball. More particularly, it relates to a multi-piece solid golf ball having excellent flight performance, accomplished by optimizing a trajectory of a hit golf ball.

BACKGROUND OF THE INVENTION

Golf balls, which are commercially selling, are typically classified into thread wound golf balls and solid golf balls. In the solid golf balls, a two-piece solid golf ball composed of a core and a cover covering the core, and a multi-piece solid golf ball, such as a three-piece solid golf ball comprising an intermediate layer between the core and the cover of the two-piece solid golf ball, generally occupy a greater part of the golf ball market. The multi-piece solid golf ball has excellent flight performance and good shot feel at the time of hitting, because of accomplishing various hardness distributions as compared with the two-piece golf ball.

For example, a three-piece solid golf ball comprising a two-piece core composed of a core and an intermediate layer, which is formed from vulcanized rubber material having the same composition as the core of the two-piece solid golf ball, is suggested in Japanese Patent Kokai publications Nos. 228978/1990, 332247/1996, 322948/1997, 216271/1998 and the like. These golf balls are characterized by making a thickness of an intermediate layer to relatively thicker, that is, not less than 1.5 mm. The golf balls are, however, classified into two depending on whether the intermediate layer is harder or softer than an inner core.

In the three-piece solid golf balls described in Japanese Patent Kokai publications Nos. 228978/1990 and 332247/1996, of which the intermediate layer is harder than the inner core, the flight performance is excellent, but the shot feel is poor, because the intermediate layer is thick and hard. Therefore, the golf balls have very soft core in order to accomplish soft and good shot feel. However, in the golf balls, the shot feel when hit by golfers who swing the golf club at low head speed is hard and poor, if the shot feel when hit by golfers who swing the golf club at high head speed is designed to be soft and good. On the other hand, the shot feel when hit by golfers who swing the golf club at high head speed is heavy and poor, if the shot feel when hit by golfers who swing the golf club at low head speed is designed to be soft and good.

In the three-piece solid golf balls described in Japanese Patent Kokai publications Nos. 322948/1997 and 216271/1998, of which the intermediate layer is softer than the inner core, the rebound characteristics are largely degraded, which reduces the flight distance when hit particularly by golfers who swing the golf club at low head speed.

The three-piece solid golf balls are designed to accomplish high launch angle and low spin amount in order to improve the flight distance. However, since each layer in the golf ball has different deformation process on impact, a desired spin amount is not always obtained. Therefore it has been a problem that the golf ball creates blow-up trajectory or drops, which reduces the flight distance.

OBJECTS OF THE INVENTION

A main object of the present invention is to provide a multi-piece solid golf ball having excellent flight performance, which accomplished by optimizing the trajectory of the hit golf ball.

According to the present invention, the object described above has been accomplished by providing a multi-piece solid golf ball comprising a core consisting of an inner core and an outer core formed on the inner core, and a cover covering the core and having many dimples on the surface thereof, and adjusting a total number of the dimples (N), a quotient (Y) obtained by dividing A by B (A/B), in which A ($mm^2$) is a total area of a plane defined by a dimple edge, and B ($mm^2$) is a surface area of a sphere when the sphere is formed assuming that there is no dimple on the cover, and a deformation amount when applying from an initial load of 10 kgf to a final load of 130 kgf on the golf ball (H (mm)) to a specified range, thereby providing a multi-piece solid golf ball having excellent flight performance, accomplished by optimizing a trajectory of a hit golf ball.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustration only, and thus are not limitative of the present invention, and wherein.

SUMMARY OF THE INVENTION

The present invention provides a multi-piece solid golf ball comprising a core consisting of an inner core and an outer core formed on the inner core, and a cover covering the core and having many dimples on the surface thereof, wherein assuming that a total number of the dimples is represented as N, a quotient (Y) is obtained by dividing A by B (A/B), in which A ($mm^2$) is a total area of a plane defined by a dimple edge, and B ($mm^2$) is a surface area of a sphere when the sphere is formed assuming that there is no dimple on the cover, and a deformation amount when applying from an initial load of 10 kgf to a final load of 130 kgf on the golf ball is represented as H (mm), the golf ball satisfies the following formula:

$$1020 \leqq (NY+266H) \leqq 1085.$$

In order to practice the present invention suitably, it is preferable that the surface hardness in JIS-C hardness of the outer core is higher than the center hardness in JIS-C hardness of the inner core, and is lower than the surface hardness in JIS-C hardness of the inner core, and the golf ball has a deformation amount of 2.6 to 3.2 mm, when applying from an initial load of 10 kgf to a final load of 130 kgf.

DETAILED DESCRIPTION OF THE INVENTION

Figure 1:
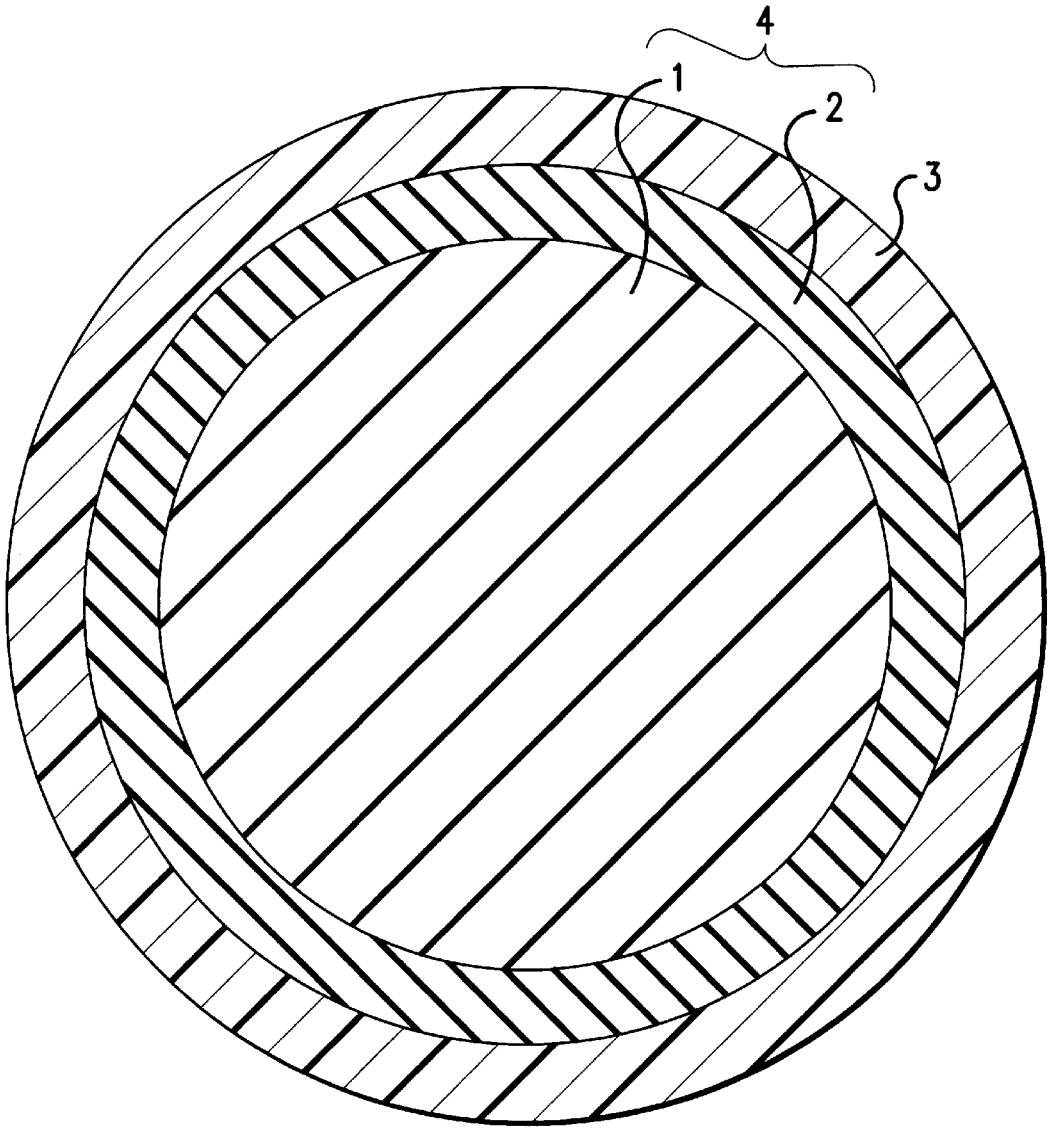
FIG. 1 is a schematic cross section illustrating one embodiment of the golf ball of the present invention.

The multi-piece solid golf ball of the present invention will be explained with reference to the accompanying drawing in detail. FIG. 1 is a schematic cross section illustrating one embodiment of the multi-piece solid golf ball of the present invention. As shown in FIG. 1, the golf ball of the present invention comprises a core 4 consisting of an inner core 1 and an outer core 2 formed on the inner core 1, and a cover 3 covering the core 4.

The core 4, including both the inner core 1 and the outer core 2, is obtained from a rubber composition. The rubber composition essentially contains polybutadiene, a co-crosslinking agent, an organic peroxide and a filler.

The polybutadiene used for the core 4 of the present invention may be one, which has been conventionally used for cores of solid golf balls. Preferred is high-cis polybutadiene rubber containing a cis-1, 4 bond of not less than 40%, preferably not less than 80%. The high-cis polybutadiene rubber may be optionally mixed with natural rubber, polyisoprene rubber, styrene-butadiene rubber, ethylene-propylene-diene rubber (EPDM) and the like.

The co-crosslinking agent can be a metal salt of α,β-unsaturated carboxylic acid, including mono or divalent metal salts, such as zinc or magnesium salts of α,β-unsaturated carboxylic acids having 3 to 8 carbon atoms (e.g. acrylic acid, methacrylic acid, etc.), or a blend of the metal salt of α,β-unsaturated carboxylic acid and acrylic ester or methacrylic ester and the like. The preferred co-crosslinking agent for the inner core is zinc acrylate because it imparts high rebound characteristics to the resulting golf ball, and the preferred co-crosslinking agent for the outer core is magnesium methacrylate because it imparts good releasability from a mold to the core. The amount of the co-crosslinking agent is from 5 to 70 parts by weight, preferably from 10 to 50 parts by weight, based on 100 parts by weight of the polybutadiene. When the amount of the co-crosslinking agent is larger than 70 parts by weight, the core is too hard, and the shot feel is poor. On the other hand, when the amount of the co-crosslinking agent is smaller than 5 parts by weight, it is required to increase an amount of the organic peroxide in order to impart a desired hardness to the core. Therefore, the rebound characteristics are degraded, which reduces the flight distance.

The organic peroxide includes, for example, dicumyl peroxide, 1,1-bis (t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide is from 0.2 to 7.0 parts by weight, preferably 0.5 to 5.0 parts by weight, based on 100 parts by weight of the polybutadiene. When the amount of the organic peroxide is smaller than 0.2 parts by weight, the core is too soft, and the rebound characteristics are degraded, which reduces the flight distance. On the other hand, when the amount of the organic peroxide is larger than 7.0 parts by weight, it is required to decrease an amount of the co-crosslinking agent in order to impart a desired hardness to the core. Therefore, the rebound characteristics are degraded, which reduces the flight distance.

The filler, which can be typically used for the core of solid golf ball, includes for example, inorganic filler (such as zinc oxide, barium sulfate, calcium carbonate, magnesium oxide and the like), high specific gravity metal powder filler (such as tungsten powder, molybdenum powder and the like), and the mixture thereof. The amount of the filler is not limited and can vary depending on the specific gravity and size of the cover and core, but is from 3 to 70 parts by weight, preferably from 10 to 65 parts by weight, based on 100 parts by weight of the polybutadiene. When the amount of the filler is smaller than 3 parts by weight, it is difficult to adjust the weight of the resulting golf ball. On the other hand, when the amount of the filler is larger than 70 parts by weight, the weight ratio of the rubber component in the core is small, and the rebound characteristics reduce too much.

The rubber compositions for the inner core and outer core of the golf ball of the present invention can contain other components, which have been conventionally used for preparing the core of solid golf balls, such as antioxidant or peptizing agent. If used, the amount of the antioxidant is preferably 0.1 to 1.0 parts by weight, and an amount of the peptizing agent is preferably 0.1 to 5.0 parts by weight, based on 100 parts by weight of the polybutadiene.

Figure 2:
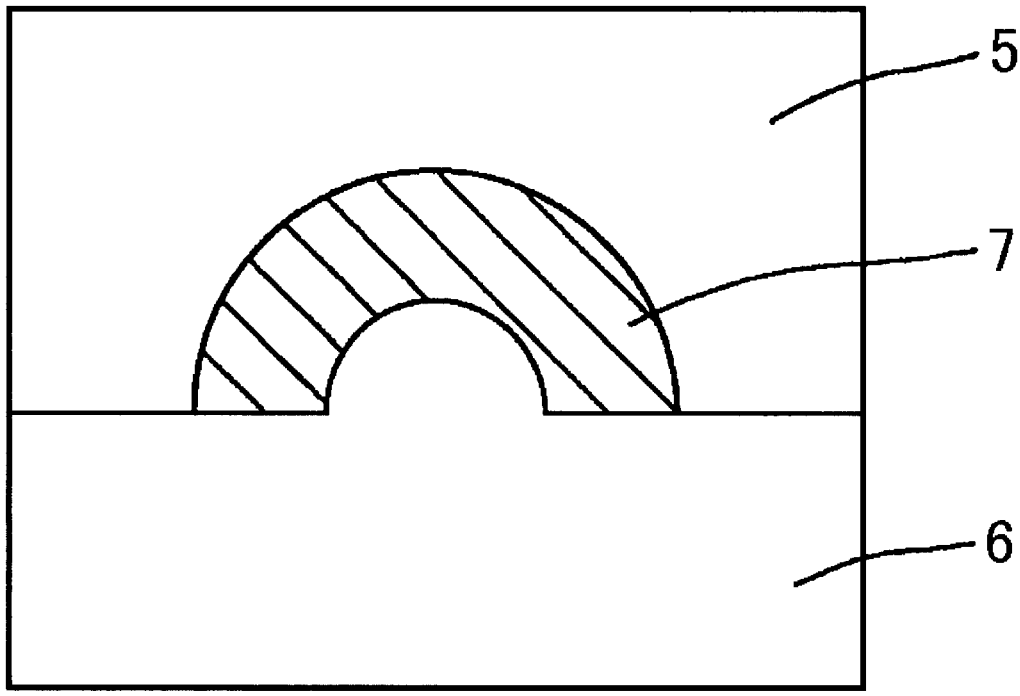
FIG. 2 is a schematic cross section illustrating one embodiment of a mold for molding an outer core of the golf ball of the present invention.
Figure 3:
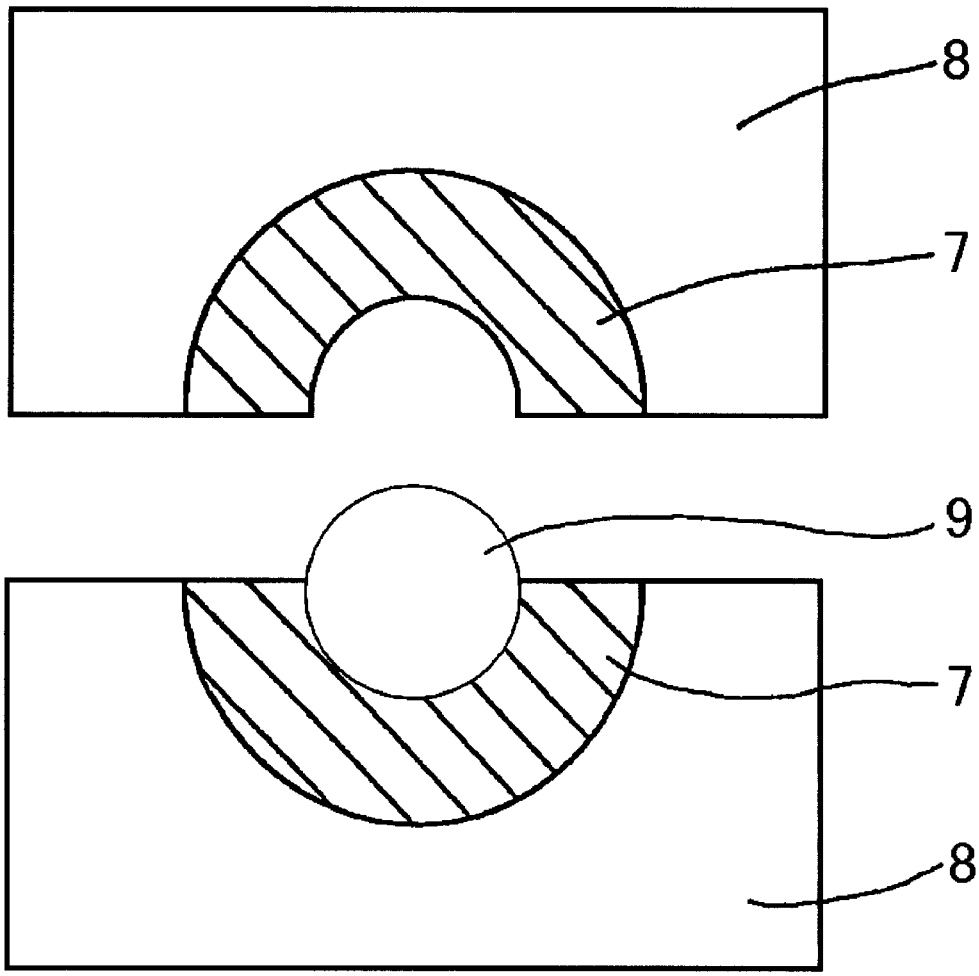
FIG. 3 is a schematic cross section illustrating one embodiment of a mold for molding a core of the golf ball of the present invention.

The process of producing the core having two-layer structure of the golf ball of the present invention will be explained with reference to FIG. 2 and FIG. 3. FIG. 2 is a schematic cross section illustrating one embodiment of a mold for molding an outer core of the golf ball of the present invention. FIG. 3 is a schematic cross section illustrating one embodiment of a mold for molding a core of the golf ball of the present invention. The rubber composition for the inner core is molded by using an extruder to form a cylindrical unvulcanized inner core. The rubber composition for the outer core is then vulcanized by press-molding, for example, at 120 to 160° C. for 2 to 15 minutes using a mold having a semi-spherical cavity 5 and a male plug mold 6 having a semi-spherical convex having the same shape as the inner core as described in FIG. 2 to obtain a vulcanized semi-spherical half-shell 7 for the outer core. The unvulcanized inner core 9 is covered with the two vulcanized semi-spherical half-shells 7 for the outer core, and then vulcanized by integrally press-molding, for example, at 140 to 180° C. for 10 to 60 minutes in a mold 8 for molding a core, which is composed of an upper mold and a lower mold, as described in FIG. 3 to obtain the core 4. The core 4 is composed of the inner core 1 and the outer core 2 formed on the inner core.

In the golf ball of the present invention, the inner core 1 has a diameter of 30 to 40.4 mm, preferably 34.2 to 39.4 mm, more preferably 35.6 to 38.6 mm. When the diameter of the inner core is smaller than 30 mm, it is required to increase the thickness of the outer core or the cover to a thickness more than a desired thickness. Therefore, the rebound characteristics are degraded, or the shot feel is hard and poor. On the other hand, when the diameter of the inner core is larger than 40.4 mm, it is required to decrease the thickness of the outer core or the cover to a thickness less than a desired thickness. Therefore the technical effect accomplished by the presence of the outer core is not sufficiently obtained.

In the golf ball of the present invention, it is desired that the inner core 1 have a surface hardness in JIS-C hardness of 60 to 85, preferably 70 to 84, more preferably 72 to 82. When the hardness is smaller than 60, the shot feel is heavy and poor, and the inner core is too soft, and the rebound characteristics are degraded, which reduces the flight distance. On the other hand, when the hardness is larger than 85, the inner core is too hard, and the shot feel is hard and poor.

In the golf ball of the present invention, it is desired that the surface hardness of the inner core be higher than a center hardness in JIS-C hardness. It is desired that the hardness difference be 5 to 30, preferably 7 to 15. When the hardness difference is smaller than 5, the shot feel is hard and poor, and the impact force is large. In addition, the launch angle is small, which reduces the flight distance. When the hardness difference is larger than 30, the shot feel is heavy and poor, and the rebound characteristics are degraded, which reduces the flight distance.

It is desired that the inner core have the center hardness in JIS-C hardness of 55 to 80, preferably 65 to 75. When the hardness is smaller than 55, the shot feel is heavy and poor, and the inner core is too soft and the rebound characteristics are degraded, which reduces the flight distance. On the other hand, when the hardness is larger than 80, the shot feel is hard and poor, and the rebound characteristics are sufficiently obtained, but the launch angle is small, which reduces the flight distance.

The center hardness of the inner core as used herein is determined by measuring a hardness at the center point of the inner core in section, after the core, which is formed by integrally press-molding the inner core and the outer core, is cut into two equal parts. The surface hardness of the inner core as used herein is determined by measuring a hardness at the surface of inner the core, after removing the outer core 2 from the core to expose the inner core 1.

In the golf ball of the present invention, the outer core 2 has a thickness of 0.2 to 1.3 mm, preferably 0.2 to 0.9 mm, more preferably 0.3 to 0.8 mm. When the thickness is smaller than 0.2 mm, the technical effect accomplished by the presence of the outer core is not sufficiently obtained, and the shot feel is hard and poor, and the launch angle is small, which reduces the flight distance. On the other hand, when the thickness is larger than 1.3 mm, the shot feel is heavy and poor, and the rebound characteristics are degraded. In addition, since the deformation amount at the time of hitting is large, the area contacted with the golf club is large, and the spin amount is large, which reduces the flight distance.

In the present invention, it is desired that the surface hardness in JIS-C hardness of the outer core 2 be higher than the center hardness in JIS-C hardness of the inner core 1, and is lower than the surface hardness in JIS-C hardness of the inner core 1. When the surface hardness of the outer core 2 is not more than the center hardness of the inner core 1, the area contacted with the golf club is large, and the spin amount is large, which reduces the flight distance, because the deformation amount at the time of hitting is large. When the surface hardness in of the outer core 2 is not less than the surface hardness of the inner core 1, the spin amount is too small, and the trajectory is low and drops, which reduces the flight distance. In addition, the shot feel is hard and poor. It is desired that the surface hardness of the outer core 2 be lower than the surface hardness of the inner core 1 by 2 to 25, preferably 4 to 20, more preferably 5 to 15.

In the golf ball of the present invention, it is desired that the outer core 2 have a surface hardness in JIS-C hardness of 55 to 83, preferably 70 to 80. When the surface hardness is smaller than 55, the launch angle is small, and the rebound characteristics are degraded, which reduces the flight distance. On the other hand, when the surface hardness is larger than 83, the outer core is too hard, and the shot feel is poor. As used herein, the term "a surface hardness of the outer core" means the surface hardness of the core having a two-layered structure, which is formed by integrally press-molding the inner core and the outer core.

In the golf ball of the present invention, the outer core 2 is preferably formed by press-molding the rubber composition as used in the inner core 1, which essentially contains polybutadiene, a co-crosslinking agent, an organic peroxide and a filler. Since the outer core 2, which is not formed from thermoplastic resin, such as ionomer resin, thermoplastic elastomer, diene copolymer and the like, is formed from the press-molded article of the rubber composition, the rebound characteristics are improved.

Since the inner core 1 and the outer core 2 are formed from the same vulcanized rubber composition, the adhesion between the inner core 1 and the outer core 2 is excellent, and the durability is improved. Rubber, when compared with resin, has a little deterioration of performance at low temperature lower than room temperature as known in the art, and thus the outer core of the present invention formed from the rubber has excellent rebound characteristics at low temperature.

A cover 3 is then covered on the core 4. In the golf ball of the present invention, the cover 3 preferably has single-layer structure, that is, a three-piece solid golf ball, in view of productivity, but the cover may have multi-layer structure, which has two or more layers.

It is desired that the cover 3 have a thickness of 1.0 to 3.0 mm, preferably 1.5 to 2.6 mm, more preferably 1.8 to 2.4 mm. When the thickness of the cover 3 is smaller than 1.0 mm, the rebound characteristics are degraded, which reduces the flight distance. On the other hand, when the thickness is larger than 3.0 mm, the shot feel is hard and poor. In the golf ball of the present invention, it is desired that the cover 3 have a Shore D of 58 to 75, preferably 63 to 75, more preferably 66 to 75. When the hardness of the cover 3 is smaller than 58, the spin amount is large, and the rebound characteristics are degraded, which reduces the flight distance. On the other hand, when the cover hardness is larger than 75, the shot feel is hard and poor. The cover hardness as used herein is determined by measuring a hardness at the surface of the golf ball, which is obtained by covering the core having a two-layered structure with the cover. If the cover has multi-layer structure, which has two or more layers, it is desired that the thickness and hardness of the outmost layer of the cover be within the above range.

The cover 3 of the present invention contains thermoplastic resin, particularly ionomer resin, which has been conventionally used for the cover of golf balls, as a base resin. The ionomer resin may be a copolymer of ethylene and α,β-unsaturated carboxylic acid, of which a portion of carboxylic acid groups is neutralized with metal ion, or a terpolymer of ethylene, α,β-unsaturated carboxylic acid and α,β-unsaturated carboxylic acid ester, of which a portion of carboxylic acid groups is neutralized with metal ion. Examples of the α,β-unsaturated carboxylic acid in the ionomer include acrylic acid, methacrylic acid, fumaric acid, maleic acid, crotonic acid and the like, preferred are acrylic acid and methacrylic acid. Examples of the α,β-unsaturated carboxylic acid ester in the ionomer include methyl ester, ethyl ester, propyl ester, n-butyl ester and isobutyl ester of acrylic acid, methacrylic acid, fumaric acid, maleic acid, crotonic acid and the like. Preferred are acrylic acid esters and methacrylic acid esters. The metal ion which neutralizes a portion of carboxylic acid groups of the copolymer or terpolymer includes a sodium ion, a potassium ion, a lithium ion, a magnesium ion, a calcium ion, a zinc ion, a barium ion, an aluminum, a tin ion, a zirconium ion, cadmium ion, and the like. Preferred are sodium ions, zinc ions, magnesium ions and the like, in view of rebound characteristics, durability and the like.

The ionomer resin is not limited, but examples thereof will be shown by a trade name thereof. Examples of the ionomer resins, which are commercially available from Mitsui Du Pont Polychemical Co., Ltd. include Hi-milan 1555, Hi-milan 1557, Hi-milan 1605, Hi-milan 1652, Hi-milan 1702, Hi-milan 1705, Hi-milan 1706, Hi-milan 1707, Hi-milan 1855, Hi-milan 1856 and the like. Examples of the ionomer resins, which are commercially available from Du Pont Co., include Surlyn 8945, Surlyn 9945, Surlyn AD8511, Surlyn AD8512, Surlyn AD8542 and the like. Examples of the ionomer resins, which are commercially available from Exxon Chemical Co., include Iotek 7010, Iotek 8000 and the like. These ionomer resins may be used alone or in combination.

As the materials suitably used in the cover 3 of the present invention, the above ionomer resin may be used alone, but the ionomer resin may be used in combination with at least one of thermoplastic elastomer, diene block copolymer and the like. In order to maintain high rebound characteristics, it is desired to contain the ionomer resin in amount of not less than 40 parts by weight, preferably not less than 50 parts by weight, more preferably not less than 65 parts by weight, based on 100 parts by weight of a base resin for the cover.

Examples of the thermoplastic elastomers include polyamide thermoplastic elastomer, which is commercially available from Toray Co., Ltd. under the trade name of "Pebax" (such as "Pebax 2533"); polyester thermoplastic elastomer, which is commercially available from Toray-Do Pont Co., Ltd. under the trade name of "Hytrel" (such as "Hytrel 3548", "Hytrel 4047"); polyurethane thermoplastic elastomer, which is commercially available from Takeda Verdishe Co., Ltd. under the trade name of "Elastoran" (such as "Elastoran ET880"); and the like.

The diene block copolymer is a block copolymer or partially hydrogenated block copolymer having double bond derived from conjugated diene compound. The base bock copolymer is block copolymer composed of block polymer block A mainly comprising at least one aromatic vinyl compound and polymer block B mainly comprising at least one conjugated diene compound. The partially hydrogenated block copolymer is obtained by hydrogenating the block copolymer. Examples of the aromatic vinyl compounds comprising the block copolymer include styrene, α-methyl styrene, vinyl toluene, p-t-butyl styrene, 1,1-diphenyl styrene and the like, or mixtures thereof. Preferred is styrene. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof. Examples of the diene block copolymers include an SBS (styrene-butadiene-styrene) block copolymer having polybutadiene block with epoxy groups or SIS (styrene-isoprene-styrene) block copolymer having polyisoprene block with epoxy groups and the like. Examples of the diene block copolymers which is commercially available include the diene block copolymers, which are commercially available from Daicel Chemical Industries, Ltd. under the trade name of "Epofriend" (such as "Epofriend A1010") and the like.

The amount of the thermoplastic elastomer or diene block copolymer is 1 to 60 parts by weight, preferably 1 to 50 parts by weight, more preferably 1 to 35 parts by weight, based on 100 parts by weight of the base resin for the cover. When the amount is smaller than 1 parts by weight, the technical effect of absorbing the impact force at the time of hitting accomplishing by using them is not sufficiently obtained. On the other hand, when the amount is larger than 60 parts by weight, the cover is too soft and the rebound characteristics are degraded, or the compatibility with the ionomer resin is degraded and the durability is degraded.

The composition for the cover 3 used in the present invention may optionally contain pigments (such as titanium dioxide, etc.) and the other additives such as a dispersant, an antioxidant, a UV absorber, a photostabilizer and a fluorescent agent or a fluorescent brightener, etc., in addition to the resin component, as long as the addition of the additives does not deteriorate the desired performance of the golf ball cover.

A method of covering on the core 4 with the cover 3 is not specifically limited, but may be a conventional method. For example, there can be used a method comprising molding the cover composition into a semi-spherical half-shell in advance, covering the core, which is covered with the outer core, with the two half-shells, followed by pressure molding at 130 to 170° C. for 1 to 5 minutes, or a method comprising injection molding the cover composition directly on the core, which is covered with the core, to cover it. At the time of molding the cover, many depressions called "dimples" may be optionally formed on the surface of the golf ball. Furthermore, paint finishing or marking with a stamp may be optionally provided after the cover is molded for commercial purposes.

In the golf ball of the present invention, as described above, a relation of the total number of the dimple (N), the quotient (Y) obtained by dividing A by B (A/B), herein A ($mm^2$) is the total area of the plane defined by dimple edge, and B ($mm^2$) is the surface area of an assumed sphere when assuming that there is no dimple on the cover, and a deformation amount (H (mm)) when applying from an initial load of 10 kgf to a final load of 130 kgf on the golf ball is represented by the following formula:

$$1020 \leqq (NY+266H) \leqq 1085.$$

It is desired that the value of N be within the range of 300 to 500, preferably 370 to 440, and the value of Y be within the range of 0.60 to 0.85, preferably 0.72 to 0.78. The product (NY) of N by Y is preferably within the range of 280 to 400 in view of aeroballistic properties. It is desired that the value of H be within the range of 2.6 to 3.2 mm, preferably 2.6 to 3.1 mm. When the value of H is larger than 3.2 mm, the shot feel is heavy and poor. On the other hand, when the value of H is smaller than 2.6 mm, the shot feel is hard and poor.

When the value of (NY+266H) is too small, the golf ball creates blown-up trajectory and drops on the way, which reduces flight distance. On the other hand, when the value of (NY+266H) is too large, the golf ball creates low angle trajectory, which reduces flight distance. Therefore the above formula is preferably the following formula:

$$1023 \leqq (NY+266H) \leqq 1084,$$

more preferably the following formula:

$1040 \leqq (NY+266H) \leqq 1070$.

EXAMPLES

The following Examples and Comparative Examples further illustrate the present invention in detail but are not to be construed to limit the scope of the present invention.

(i) Production of unvulcanized inner core

The rubber compositions for the inner core having the formulation shown in Tables 1 and 2 (Examples) and Table 3 (Comparative Examples) were mixed, and then extruded to obtain cylindrical unvulcanized plugs.

(ii) Production of vulcanized semi-spherical half-shell for the outer core

The rubber compositions for the outer core having the formulation shown in Tables 1 and 2 (Examples) and Table 3 (Comparative Examples) were mixed, and then vulcanized by press-molding at the vulcanization condition shown in the same Tables in the mold (5, 6) as described in FIG. 2 to obtain vulcanized semi-spherical half-shells 7 for the outer core.

(iii) Production of core

The unvulcanized plugs 9 for the inner core produced in the step (i) were covered with the two vulcanized semi-spherical half-shells 7 for the outer core produced in the step (ii), and then vulcanized by press-molding at the vulcanization condition shown in Tables 1 and 2 (Examples) and Table 3 (Comparative Examples) in the mold 8 as described in FIG. 3 to obtain cores 4 having a two-layered structure. A surface hardness in JIS-C hardness of the resulting core 4 was measured. The results are shown in Tables 7 to 9 (Examples) and Table 9 (Comparative Examples) as a surface hardness of the outer core (c). The specific gravity, diameter, center hardness (a) and surface hardness (b) of the inner core, and the specific gravity and thickness of the outer core were also measured. The specific gravity of the inner core was 1.150, and the diameter of the inner core was 36.9 mm. The specific gravity of the outer core was 1.332, and the thickness of the outer core was 0.5 mm. The hardness (center hardness and surface hardness) of the inner core are shown in the same Tables. The hardness difference (c−a) and (b−c) were calculated. The results are shown in the same Tables.

TABLE 1

(parts by weight)

| Core composition | | Example No. 1 | 2 | 3 | 4 | 5 | 6 |
|---|---|---|---|---|---|---|---|
| (Inner core composition) | | | | | | | |
| BR-18 | *1 | 100 | 100 | 100 | 100 | 100 | 100 |
| Zinc acrylate | | 28 | 29 | 30.5 | 30.5 | 26 | 26 |
| Zinc oxide | | 10.2 | 9.0 | 7.2 | 7.2 | 12.6 | 12.6 |
| Tungsten | | 10 | 10 | 10 | 10 | 10 | 10 |
| Dicumyl peroxide | | 0.6 | 0.6 | 0.6 | 0.6 | 0.6 | 0.6 |
| Diphenyl disulfide | | 0.5 | 0.5 | 0.5 | 0.5 | 0.5 | 0.5 |
| (Outer core composition) | | | | | | | |
| BR-10 | *2 | 20 | 20 | 20 | 20 | 20 | 20 |
| BR-11 | *3 | 80 | 80 | 80 | 80 | 80 | 80 |
| Magnesium methacrylate | | 25 | 25 | 25 | 25 | 25 | 25 |
| Magnesium oxide | | 23 | 23 | 23 | 23 | 23 | 23 |
| Tungsten | | 39.1 | 39.1 | 39.1 | 39.1 | 39.1 | 39.1 |
| Dicumyl peroxide | | 2.0 | 2.0 | 2.0 | 2.0 | 2.0 | 2.0 |
| Vulcanization condition: temperature (° C.) × time (min) | | | | | | | |
| Outer core | (° C.) | 150 | 150 | 150 | 150 | 150 | 150 |
| | (min) | 5 | 5 | 5 | 5 | 5 | 5 |
| Core The first stage | (° C.) | 150 | 150 | 150 | 160 | 150 | 150 |
| | (min) | 25 | 25 | 25 | 15 | 25 | 25 |
| The second stage | (° C.) | 165 | 165 | 165 | 165 | 165 | 165 |
| | (min) | 8 | 8 | 8 | 8 | 8 | 8 |

TABLE 2

(parts by weight)

| Core composition | | Example No. 7 | 8 | 9 | 10 | 11 | 12 |
|---|---|---|---|---|---|---|---|
| (Inner core composition) | | | | | | | |
| BR-18 | *1 | 100 | 100 | 100 | 100 | 100 | 100 |
| Zinc acrylate | | 27 | 27 | 28 | 29 | 28 | 28 |
| Zinc oxide | | 16.5 | 16.5 | 10.2 | 9.0 | 10.2 | 10.2 |
| Tungsten | | 10 | 10 | 10 | 10 | 10 | 10 |
| Dicumyl peroxide | | 0.6 | 0.6 | 0.6 | 0.6 | 0.6 | 0.6 |
| Diphenyl disulfide | | 0.5 | 0.5 | 0.5 | 0.5 | 0.5 | 0.5 |
| (Outer core composition) | | | | | | | |
| BR-10 | *2 | 20 | 20 | 20 | 20 | 20 | 20 |
| BR-11 | *3 | 80 | 80 | 80 | 80 | 80 | 80 |
| Magnesium methacrylate | | 25 | 25 | 25 | 25 | 25 | 25 |
| Magnesium oxide | | 23 | 23 | 23 | 23 | 23 | 23 |
| Tungsten | | 39.1 | 39.1 | 39.1 | 39.1 | 39.1 | 39.1 |
| Dicumyl peroxide | | 2.0 | 2.0 | 2.0 | 2.0 | 4.0 | 0.5 |
| Vulcanization condition: temperature (° C.) × time (min) | | | | | | | |
| Outer core | (° C.) | 150 | 150 | 150 | 150 | 150 | 150 |
| | (min) | 5 | 5 | 5 | 5 | 5 | 5 |
| Core The first stage | (° C.) | 160 | 160 | 150 | 150 | 140 | 150 |
| | (min) | 15 | 15 | 25 | 25 | 30 | 25 |
| The second stage | (° C.) | 165 | 165 | 165 | 165 | 165 | 165 |
| | (min) | 8 | 8 | 8 | 8 | 8 | 8 |

TABLE 3

(parts by weight)

| Core composition | | Comparative Example No. 1 | 2 | 3 |
|---|---|---|---|---|
| (Inner core composition) | | | | |
| BR-18 | *1 | 100 | 100 | 100 |
| Zinc acrylate | | 30.5 | 30.5 | 26 |
| Zinc oxide | | 7.2 | 7.2 | 12.6 |
| Tungsten | | 10 | 10 | 10 |
| Dicumyl peroxide | | 0.6 | 0.6 | 0.6 |
| Diphenyl disulfide | | 0.5 | 0.5 | 0.5 |
| (Outer core composition) | | | | |
| BR-10 | *2 | 20 | 20 | 20 |
| BR-11 | *3 | 80 | 80 | 80 |
| Magnesium methacrylate | | 25 | 25 | 25 |
| Magnesium oxide | | 23 | 23 | 23 |
| Tungsten | | 39.1 | 39.1 | 39.1 |
| Dicumyl peroxide | | 2.0 | 2.0 | 2.0 |
| Vulcanization condition: temperature (° C.) × time (min) | | | | |
| Outer core | (° C.) | 150 | 150 | 150 |

TABLE 3-continued

| Core composition | | | (parts by weight) Comparative Example No. 1 | 2 | 3 |
|---|---|---|---|---|---|
| | | (min) | 5 | 5 | 5 |
| Core | The first stage | (° C.) | 150 | 150 | 150 |
| | | (min) | 25 | 25 | 25 |
| | The second stage | (° C.) | 165 | 165 | 165 |
| | | (min) | 8 | 8 | 8 |

(iv) Preparation of cover compositions

The formulation materials showed in Table 4 (Examples) and Table 5 (Comparative Examples) were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 150 to 260° C. at the die position of the extruder.

TABLE 4

| Cover composition | | (parts by weight) A | B |
|---|---|---|---|
| Hi-milan 1605 | *4 | 60 | — |
| Hi-milan 1706 | *5 | 40 | — |
| Iotek 8000 | *6 | — | 40 |
| Iotek 7010 | *7 | — | 60 |
| Titanium dioxide | | 3 | 3 |
| Barium sulfate | | 1 | 1 |
| Sanol LS770 | *8 | 0.2 | 0.2 |

*4: Hi-milan 1605 (trade name), ethylene-methacrylic acid copolymer ionomer resin obtained by neutralizing with sodium ion, manufactured by Mitsui Du Pont Polychemical Co., Ltd.
*5: Hi-milan 1706 (trade name), ethylene-methacrylic acid copolymer ionomer resin obtained by neutralizing with zinc ion, manufactured by Mitsui Du Pont Polychemical Co., Ltd.
*6: Iotek 8000 (trade name), ethylene-acrylic acid copolymer ionomer resin obtained by neutralizing with sodium ion, manufactured by Exxon Chemical Co.
*7: Iotek 7010 (trade name), ethylene-acrylic acid copolymer ionomer resin obtained by neutralizing with zinc ion, manufactured by Exxon Chemical Co.
*8: Sanol LS770 (trade name), antioxidant manufactured by Sankyo Co., Ltd.

Examples 1 to 12 and Comparative Examples 1 to 3

Figure 5:
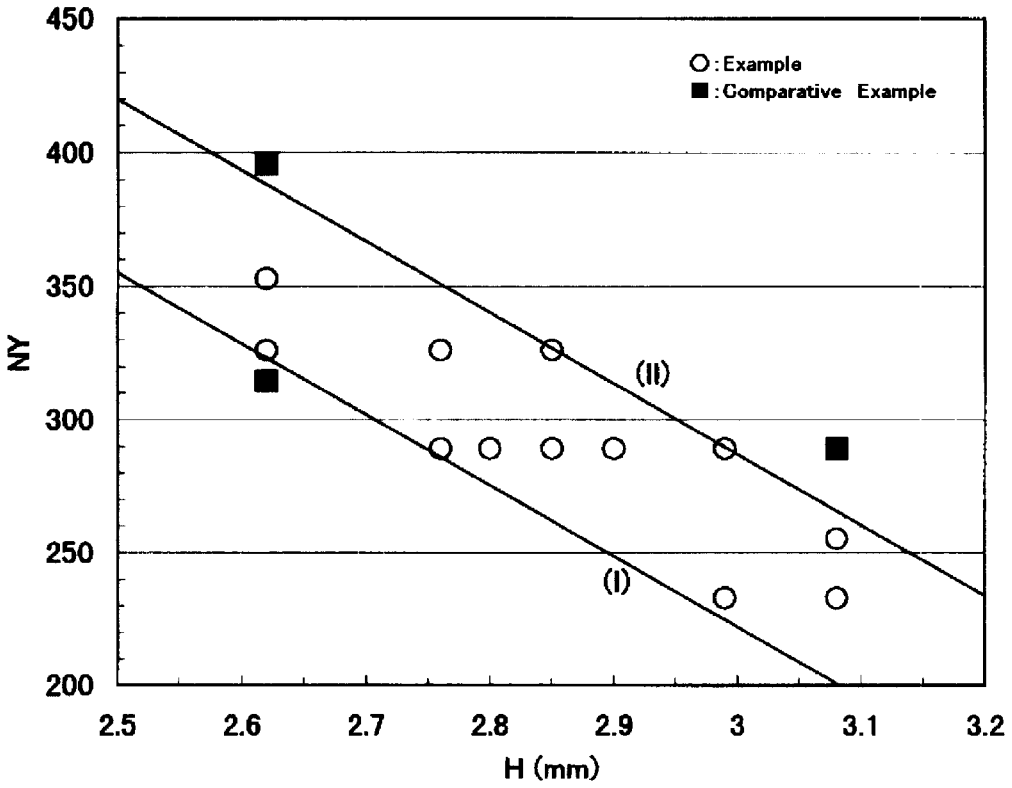
FIG. 5 is a schematic illustrating one embodiment of a dimple arrangement of the golf ball of the present invention.

The cover composition was covered on the resulting core 4 having two-layered structure by injection molding to form a cover layer 3 having the hardness shown in Tables 7 to 9 (Examples) and Table 9 (Comparative Examples), dimples shown in Tables 5 and 6 on the surface, and the thickness of 2.4 mm. Then, paint was applied on the surface to produce golf ball having a diameter of 42.7 mm. The dimple arrangement of the golf ball having dimples of type (1) is shown in FIG. 5, as a schematic illustrating one embodiment of a dimple arrangement of the golf ball of the present invention. With respect to the resulting golf balls, the launch angle, spin amount and flight distance (total) were measured. The results are shown in Tables 10 to 12 (Examples) and Table 12 (Comparative Examples). The test methods are as follows.

TABLE 5

| Type of dimples | Diameter (mm) | Number of dimple | Total number of dimple (N) | Y | NY |
|---|---|---|---|---|---|
| (1) | 4.00 | 186 | 390 | 0.741 | 289.0 |
| | 3.75 | 114 | | | |
| | 3.30 | 60 | | | |
| | 2.40 | 30 | | | |
| (2) | 4.00 | 132 | 432 | 0.755 | 326.2 |
| | 3.45 | 180 | | | |
| | 3.30 | 60 | | | |
| | 3.15 | 60 | | | |
| (3) | 3.80 | 110 | 480 | 0.735 | 352.8 |
| | 3.50 | 80 | | | |
| | 3.30 | 170 | | | |
| | 2.80 | 120 | | | |
| (4) | 3.70 | 192 | 372 | 0.626 | 232.8 |
| | 3.45 | 108 | | | |
| | 3.00 | 72 | | | |

TABLE 6

| Type of dimples | Diameter (mm) | Number of dimple | Total number of dimple (N) | Y | NY |
|---|---|---|---|---|---|
| (5) | 3.80 | 120 | 392 | 0.651 | 255.3 |
| | 3.50 | 152 | | | |
| | 3.20 | 60 | | | |
| | 3.00 | 60 | | | |
| (6) | 4.20 | 50 | 410 | 0.767 | 314.5 |
| | 3.80 | 210 | | | |
| | 3.40 | 110 | | | |
| | 3.20 | 40 | | | |
| (7) | 4.00 | 110 | 480 | 0.825 | 396.0 |
| | 3.70 | 80 | | | |
| | 3.50 | 170 | | | |
| | 3.00 | 120 | | | |

(Test method)

(1) Hardness (i) JIS-C hardness of core

The center hardness of the inner core is determined by measuring a hardness at the center point of the inner core in section, after the core, which is formed by integrally press-molding the inner core and the outer core, is cut into two equal parts. The surface hardness of the inner core is determined by measuring a hardness at the surface of inner the core, after removing the outer core from the core to expose the inner core. The surface hardness of the outer core is determined by measured a hardness at the surface of the core. The JIS-C hardness was measured with a JIS-C hardness meter according to JIS K 6301.

(ii) Shore D hardness of cover

After the golf ball is obtained by covering the core with the cover, a Shore D hardness of the cover is determined by measuring a hardness at the surface of the golf ball at 23° C. using a Shore D hardness meter according to ASTM D-2240-68.

(2) Flight Performance

After a No. 1 wood club (W#1, a driver) having a metal head or No. 5 iron club (I#5) was mounted to a swing robot manufactured by True Temper Co. and the resulting golf ball was hit at a head speed of 40 m/second or 34 m/second, respectively, the launch angle, spin amount and flight distance were measured. The spin amount was measured by continuously taking a photograph of a mark provided on the hit golf ball using a high-speed camera. As the flight distance, total that is a distance to the stop point of the hit golf ball was measured. The measurement was conducted 5 times for each golf ball, and the average is shown as the result of the golf ball.

TABLE 7

(Test result)

| Test item | Example No. 1 | 2 | 3 | 4 | 5 |
|---|---|---|---|---|---|
| Hardness of inner core (JIS-C hardness) | | | | | |
| Center hardness (a) | 67 | 68 | 70 | 70 | 65 |
| Surface hardness (b) | 78 | 8 | 83 | 83 | 84 |
| Hardness of outer core (JIS-C hardness) | | | | | |
| Surface hardness (c) | 73 | 73 | 73 | 73 | 73 |
| Hardness difference (c–a) | 6 | 5 | 3 | 3 | 8 |
| Hardness difference (b–c) | 5 | 8 | 10 | 10 | 1 |
| Cover composition | A | B | A | A | A |
| Shore D hardness of cover | 70 | 70 | 70 | 70 | 70 |
| Type of dimples | (1) | (2) | (2) | (3) | (4) |
| Value of NY | 289.0 | 326.2 | 326.2 | 352.8 | 232.8 |
| Deformation amount of ball H (mm) | 2.85 | 2.76 | 2.62 | 2.62 | 3.08 |
| Value of (NY + 266H) | 1047 | 1060 | 1023 | 1050 | 1052 |

TABLE 8

| Test item | Example No. 6 | 7 | 8 | 9 | 10 |
|---|---|---|---|---|---|
| Hardness of inner core (JIS-C hardness) | | | | | |
| Center hardness (a) | 65 | 66 | 66 | 67 | 68 |
| Surface hardness (b) | 74 | 76 | 76 | 78 | 81 |
| Hardness of outer core (JIS-C hardness) | | | | | |
| Surface hardness (c) | 73 | 73 | 73 | 73 | 73 |
| Hardness difference (c–a) | 8 | 7 | 7 | 6 | 5 |
| Hardness difference (b–c) | 1 | 3 | 3 | 5 | 8 |
| Cover composition | A | A | A | A | B |
| Shore D hardness of cover | 70 | 70 | 70 | 70 | 70 |
| Type of dimples | (5) | (1) | (4) | (2) | (1) |
| Value of NY | 255.3 | 289.0 | 232.8 | 326.2 | 289.0 |
| Deformation amount of ball H (mm) | 3.08 | 2.99 | 2.99 | 2.85 | 2.76 |
| Value of (NY + 266H) | 1075 | 1084 | 1028 | 1084 | 1023 |

TABLE 9

| Test item | Example No. 11 | 12 | Comparative Example No. 1 | 2 | 3 |
|---|---|---|---|---|---|
| Hardness of inner core (JIS-C hardness) | | | | | |
| Center hardness (a) | 70 | 67 | 67 | 67 | 65 |
| Surface hardness (b) | 75 | 78 | 78 | 78 | 74 |

TABLE 9-continued

| Test item | Example No. 11 | 12 | Comparative Example No. 1 | 2 | 3 |
|---|---|---|---|---|---|
| Hardness of outer core (JIS-C hardness) | | | | | |
| Surface hardness (c) | 78 | 65 | 73 | 73 | 73 |
| Hardness difference (c–a) | 8 | −2 | 6 | 6 | 8 |
| Hardness difference (b–c) | −3 | 13 | 5 | 5 | 1 |
| Cover composition | A | A | A | A | A |
| Shore D hardness of cover | 70 | 70 | 70 | 70 | 70 |
| Type of dimples | (1) | (1) | (6) | (7) | (1) |
| Value of NY | 289.0 | 289.0 | 314.5 | 396.0 | 289.0 |
| Deformation amount of ball H (mm) | 2.80 | 2.90 | 2.62 | 2.62 | 3.08 |
| Value of (NY + 266H) | 1034 | 1060 | 1011 | 1093 | 1108 |

TABLE 10

| Test item | Example No. 1 | 2 | 3 | 4 | 5 |
|---|---|---|---|---|---|
| Flight performance (W#1, 40 m/sec) | | | | | |
| Launch angle (degree) | 13.4 | 13.2 | 13.3 | 13.3 | 13.5 |
| Spin amount (rpm) | 3090 | 3070 | 3160 | 3160 | 3030 |
| Total (yard) | 231.9 | 232.3 | 229.1 | 232.0 | 232.1 |
| Flight performance (I#5, 34 m/sec) | | | | | |
| Launch angle (degree) | 15.2 | 15.3 | 15.0 | 15.0 | 15.4 |
| Spin amount (rpm) | 4990 | 4960 | 5150 | 5150 | 4870 |
| Total (yard) | 169.0 | 169.4 | 168.2 | 168.9 | 168.9 |

TABLE 11

| Test item | Example No. 6 | 7 | 8 | 9 | 10 |
|---|---|---|---|---|---|
| Flight performance (W#1, 40 m/sec) | | | | | |
| Launch angle (degree) | 13.5 | 13.4 | 13.4 | 13.4 | 13.2 |
| Spin amount (rpm) | 3030 | 3050 | 3050 | 3090 | 3070 |
| Flight distance (yard) | 229.5 | 227.9 | 228.1 | 228.3 | 228.6 |
| Flight performance (I#5, 34 m/sec) | | | | | |
| Launch angle (degree) | 15.4 | 15.3 | 15.3 | 15.2 | 15.3 |
| Spin amount (rpm) | 4870 | 4920 | 4920 | 4990 | 4960 |
| Flight distance (yard) | 168.0 | 167.0 | 167.3 | 167.4 | 167.8 |

TABLE 12

| Test item | Example No. 11 | Example No. 12 | Comparative Example No. 1 | Comparative Example No. 2 | Comparative Example No. 3 |
|---|---|---|---|---|---|
| Flight performance (W#1, 40 m/sec) | | | | | |
| Launch angle (degree) | 13.5 | 13.1 | 13.3 | 13.3 | 13.5 |
| Spin amount (rpm) | 2980 | 3210 | 3160 | 3160 | 3030 |
| Flight distance (yard) | 227.3 | 226.5 | 223.8 | 226.2 | 225.8 |
| Flight performance (I#5, 34 m/sec) | | | | | |
| Launch angle (degree) | 15.4 | 15.1 | 15.0 | 15.0 | 15.4 |
| Spin amount (rpm) | 4810 | 5230 | 5150 | 5150 | 4870 |
| Flight distance (yard) | 166.8 | 164.5 | 163.2 | 164.3 | 164.0 |

Figure 4:
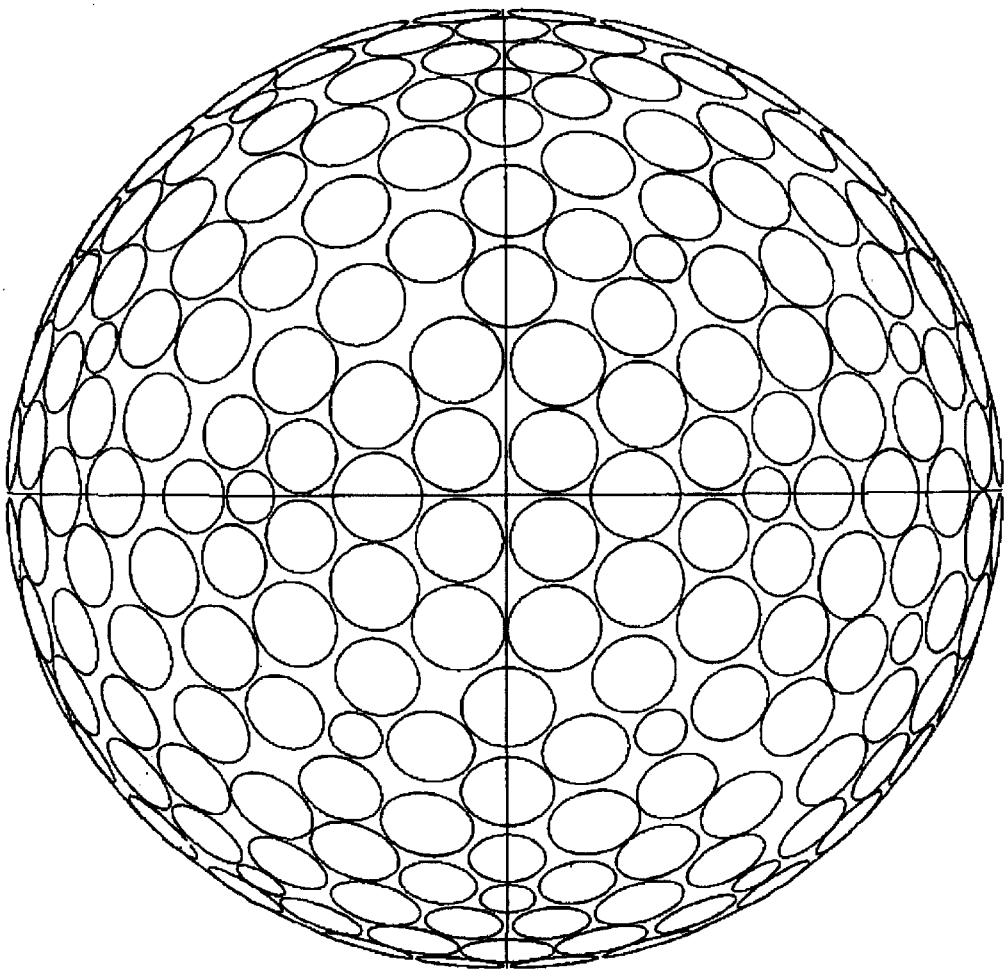
FIG. 4 is a graph illustrating the correlation of the product NY of the total number of the dimple (N) by the quotient (Y) obtained by dividing A by B (A/B) with deformation amount (H (mm)) when applying from an initial load of 10 kgf to a final load of 130 kgf on the golf ball, wherein A ($mm^2$) is the total area of the plane defined by dimple edge, and B ($mm^2$) is the surface area of an assumed sphere when assuming that there is no dimple on the cover.

With respect to the golf balls of Examples 1 to 12 and Comparative Examples 1 to 3, a graph illustrating the correlation of the value of NY with the value of H from the results of Tables 9 to 11 is FIG. 4. As is apparent from FIG. 4, all plots of the golf balls of the present invention of Examples 1 to 12 are on the line or within the area having higher NY value than the line represented by the following formula:

$$NY=-266H+1020 \quad (I)$$

and are on the line or within the area having lower NY value than the line represented by the following formula:

$$NY=-266H+1085 \quad (II)$$

That is, in the golf balls of the present invention of Examples 1 to 12, the values of NY and H are all represented by the formula (1):

$$1020 \leqq (NY+266H) \leqq 1085 \quad (1)$$

On the other hand, the plot of the golf ball of Comparative Example 1 is within the area having lower NY value than the line (I), and the plots of the golf balls of Comparative Examples 2 and 3 are within the area having higher NY value than the line (II). Therefore, in the golf balls of Comparative Examples 1 to 3, the values of NY and H are not represented by the formula (1).

As is apparent from the results of Tables 7 to 9 and FIG. 4, the golf balls of the present invention of Examples 1 to 12, which the values of NY and H are all represented by the formula (1), have longer flight distance when hit at low (34 m/second) and high head speed (40 m/second) than the golf balls of Comparative Examples, which the values of NY and H are not represented by the formula (1). The golf balls of Examples 1 to 12 do not create blow-up or low trajectory, which is preferable.

The golf ball of Example 11, which the values of NY and H are represented by the formula (1), has longer flight distance than the golf balls of Comparative Examples. However, since the surface hardness of the outer core is higher than that of the inner core, the spin amount is low, and the trajectory is slightly low, which reduces the flight distance slightly. The golf ball of Example 12, which the values of NY and H are represented by the formula (1), also has longer flight distance than the golf balls of Comparative Examples. However, since the surface hardness of the outer core is lower than the center hardness of the inner core, the spin amount is high, and the golf ball slightly creates blow-up trajectory, which reduces the flight distance slightly.

On the other hand, the golf balls of Comparative Examples 1 to 3, which the values of NY and H are not represented by the formula (1), have short flight distance. The golf ball of Comparative Example 1, which the value of (NY+266H) is smaller than 1020, creates blow-up trajectory and drops, which reduces the flight distance. The golf balls of Comparative Examples 2 and 3, which the value of (NY+266H) is larger than 1085, the trajectory of hit golf ball is low, which reduces the flight distance.

What is claimed is:

1. A multi-piece solid golf ball comprising a core consisting of an inner core and an outer core formed on the inner core, and a cover covering the core and having many dimples on the surface thereof, wherein assuming that a total number of the dimples is represented as N, a quotient (Y) is obtained by dividing A by B (A/B), in which A ($mm^2$) is a total area of a plane defined by a dimple edge, and B ($mm^2$) is a surface area of a sphere when the sphere is formed assuming that there is no dimple on the cover, and a deformation amount when applying from an initial load of 10 kgf to a final load of 130 kgf on the golf ball is represented as H (mm), the golf ball satisfies the following formula:

$$1020 \leqq (NY+266H) \leqq 1085.$$

2. The multi-piece solid golf ball according to claim 1, wherein a surface hardness in JIS-C hardness of the outer core is higher than a center hardness in JIS-C hardness of the inner core, and is lower than a surface hardness in JIS-C hardness of the inner core.

3. The multi-piece solid golf ball according to claim 2, wherein the golf ball has a deformation amount of 2.6 to 3.2 mm, when applying from an initial load of 10 kgf to a final load of 130 kgf.

4. The multi-piece solid golf ball according to claim 1, wherein the golf ball has a deformation amount of 2.6 to 3.2 mm, when applying from an initial load of 10 kgf to a final load of 130 kgf.

5. The multi-piece solid golf ball according to claim 1, wherein the inner core and outer core are formed from vulcanized rubber composition.

* * * * *